US008360429B2

(12) United States Patent
Keith et al.

(10) Patent No.: US 8,360,429 B2
(45) Date of Patent: Jan. 29, 2013

(54) EXTERNALLY-POWERABLE MEDIA TRANSPORT MODULE

(75) Inventors: Duncan Keith, Dundee (GB); Gordon Burke, Angus (GB)

(73) Assignee: NCR Corporation, Duluth, GA (US)

( * ) Notice: Subject to any disclaimer, the term of this patent is extended or adjusted under 35 U.S.C. 154(b) by 79 days.

(21) Appl. No.: 12/868,796

(22) Filed: Aug. 26, 2010

(65) Prior Publication Data

US 2012/0049444 A1 Mar. 1, 2012

(51) Int. Cl.
*B65H 39/10* (2006.01)

(52) U.S. Cl. ..... 271/302; 271/3.19; 271/178; 271/303; 271/263; 271/265.04

(58) Field of Classification Search ..... 271/263, 271/265.04, 302, 303, 178, 3.15, 3.19
See application file for complete search history.

(56) References Cited

U.S. PATENT DOCUMENTS 3,795,395 A * 3/1974 Ransom et al. ..... 271/263
4,154,437 A * 5/1979 Butcheck et al. ..... 271/263
4,159,782 A * 7/1979 Swartzendruber ..... 271/263
4,817,934 A * 4/1989 McCormick et al. ..... 271/186
5,136,144 A * 8/1992 Swinton et al. ..... 271/227
5,342,165 A * 8/1994 Graef et al. ..... 271/264
6,334,388 B1 * 1/2002 Kimura ..... 271/3.15
6,666,448 B2 * 12/2003 Sato et al. ..... 271/178
7,942,405 B2 * 5/2011 Sonnack et al. ..... 271/186
2005/0189691 A1 * 9/2005 Sonnack et al. ..... 271/2

* cited by examiner

*Primary Examiner* — Gerald McClain
(74) *Attorney, Agent, or Firm* — Michael Chan

(57) ABSTRACT

A media transport module is described. The media transport module comprises: an upward transport, a divert transport, and a stacking transport. The upward transport extends from a pick coupling area to a diversion area and is operable to route individual media items from the pick coupling area to the diversion area. The divert transport extends from the diversion area to a diverter port; and the stacking transport extends from the diversion area to a stacking port. A diverter is located at the diversion area and is operable to route media items to either (i) the divert transport, or (ii) the stacking transport, in response to a signal received from a media thickness sensor. A drive gear is provided for receiving rotational motion from an external drive. An electrical connector is also provided for receiving electrical power from an external supply and using the received electrical power to energize the diverter.

16 Claims, 7 Drawing Sheets

FIG. 4
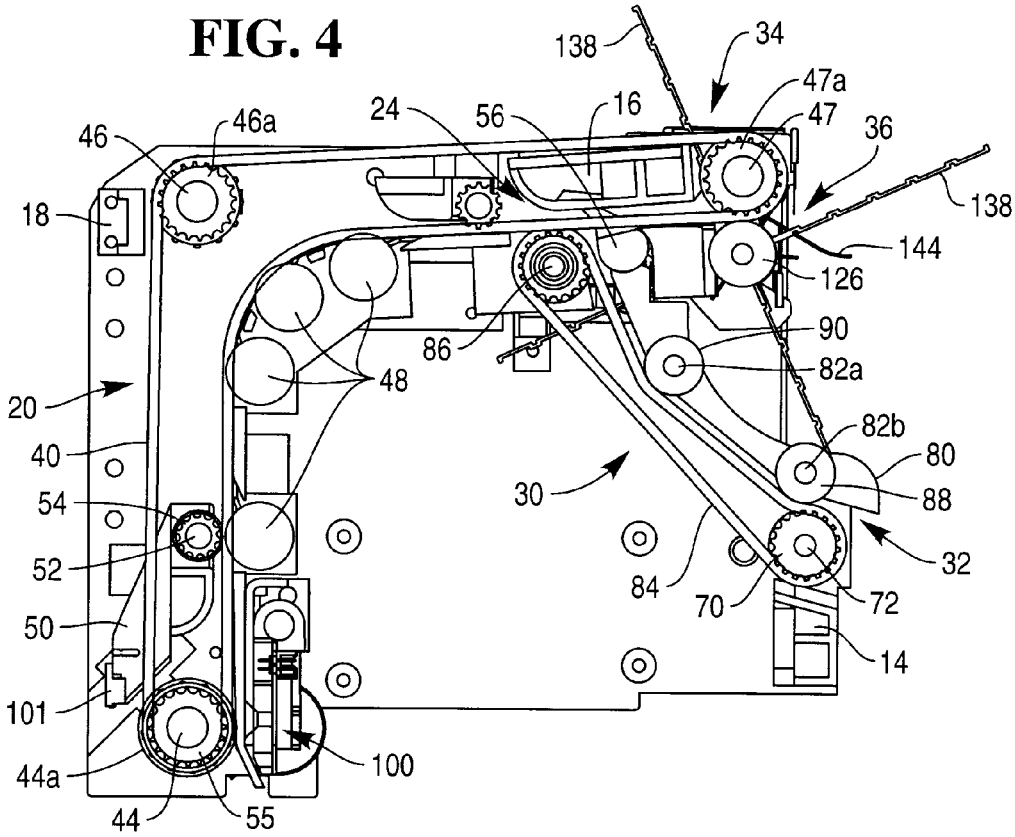
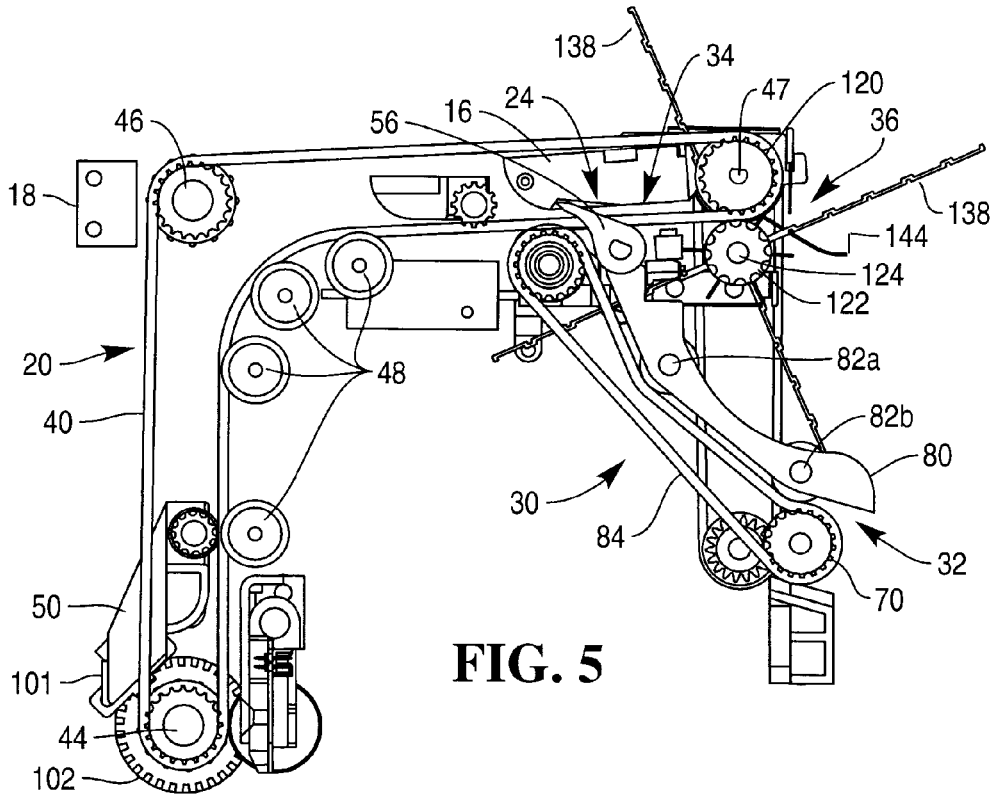
FIG. 5

FIG. 10
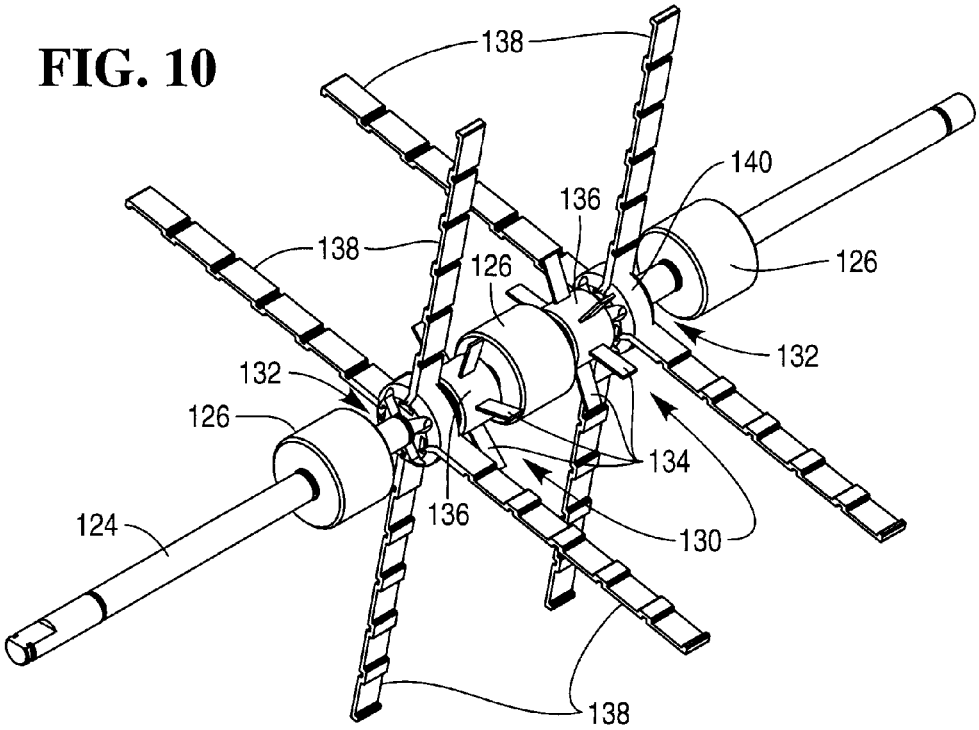
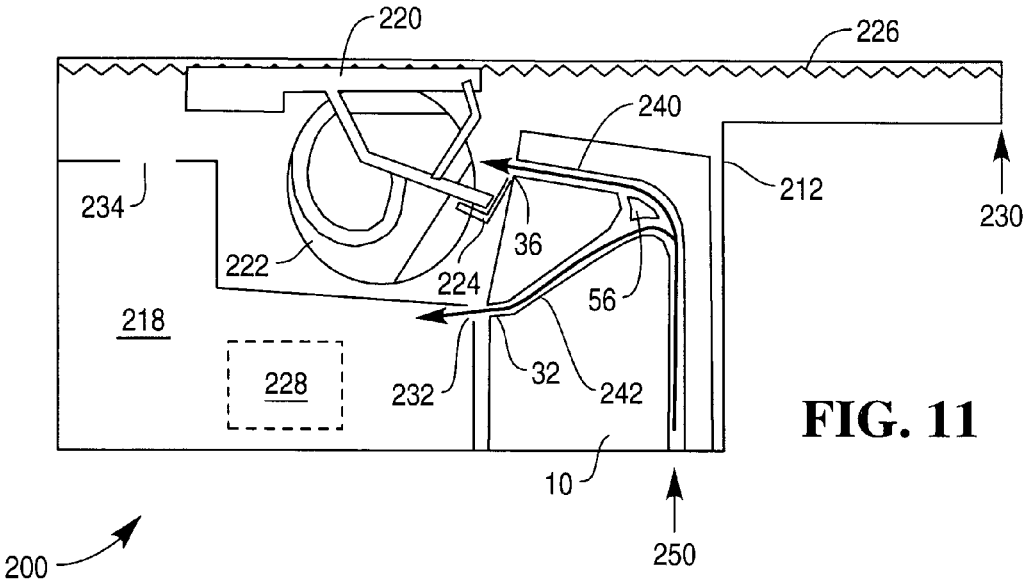
FIG. 11

EXTERNALLY-POWERABLE MEDIA TRANSPORT MODULE

FIELD OF INVENTION

The present invention relates to improvements in or relating to a media transport module.

BACKGROUND OF INVENTION

A media transport module may be used as part of a media dispenser. One type of media transport module is a media presenter. A media presenter is that part of the dispenser that receives media from one or more pick units and presents the received media items to a customer.

Media dispensers require periodic maintenance to prevent media items jamming within the media dispenser. Even with periodic maintenance, media items still jam, causing the media dispenser to go out of service. When this happens, a service engineer is dispatched to remove the jammed media item and return the media dispenser to full operation.

It is expensive to have to dispatch a service engineer. Furthermore, the longer that a service engineer must spend to restore the media dispenser to full operation, the more expensive it is for the owner of the media dispenser.

The transport sections within a media dispenser are a common cause of media jams. Depending on the design of the transport sections, it may be difficult to access a jammed media item without taking apart the media dispenser.

It would be desirable to provide an improved media transport that obviates or mitigates one or more of the above problems or other problems associated with prior art media transports.

SUMMARY OF INVENTION

Accordingly, the invention generally provides methods, systems, and apparatus for an improved media transport module.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media transport module comprising:

an upward transport extending from a pick coupling area to a diversion area and operable to route individual media items from the pick coupling area to the diversion area;

a divert transport extending from the diversion area to a diverter port;

a stacking transport extending from the diversion area to a stacking port;

a diverter located at the diversion area and operable, in response to a signal received from a media thickness sensor, to route media items to either (i) the divert transport, or (ii) the stacking transport;

a drive gear for receiving rotational motion from an external drive and imparting the received rotational motion to the upward transport, the divert transport, and the stacking transport; and an electrical connector for receiving electrical power from an external supply and using the received electrical power to energize the diverter.

The stacking port may comprise a first set of media flickers. The first set of media flickers may be mounted on a shaft. The first set of media flickers may be mounted beneath a media path defined by the stacking transport and deflected by a media item passing above the first set of media flickers. The first set of media flickers may be shorter than a width of a media item being transported, so that the first set of media flickers act to eject the media item from the stacking transport.

The stacking port may comprise a second set of media flickers. The second set of media flickers may be mounted co-axially with the first set of media flickers. The second set of media flickers may be longer than the first set of media flickers, and may also be longer than the width of a media item being transported, so that the second set of media flickers act to push down the media item once the media item has left the stacking transport, this arrangement would ensure that the first set of media flickers clear the exit port at approximately the same time as a media item is being ejected therethrough, but the second set of media flickers do not clear the exit port until after that media item has been ejected therethrough.

The media transport module may further comprise a chassis defining skid plates forming part of the upward transport, the divert transport, and/or the stacking transport.

The upward transport may further comprise one or more stretchable endless belts and/or one or more rollers, and/or any other convenient component of a media transport.

Similarly, the stacking transport may further comprise one or more stretchable endless belts and/or one or more rollers and/or any other convenient component of a media transport.

The upward transport and the stacking transport may comprise portions of a single integral transport.

The divert transport may comprise a plurality of stretchable endless belts arranged to transport one or more media items between opposing pairs of such belts.

The divert transport may comprise a plurality of stretchable endless belts co-operating with one or more skid guides to transport one or more media items therebetween.

The divert transport may comprise a plurality of stretchable endless belts co-operating with one or more rollers mounted on one or more skid plates to transport one or more media items between the belts and the rollers.

The divert transport may comprise a plurality of rollers co-operating with one or more skid plates to transport one or more media items therebetween.

The divert transport may comprise a set of rollers on one side of the divert transport co-operating with another set of rollers on the opposite side of the divert transport to transport one or more media items therebetween.

The media transport module may include a media thickness sensor, or it may receive a signal from a media thickness sensor external to the media transport module.

The media transport module may include a media width sensor operable to detect the width of a media item being transported. The media width sensor may also be operable to detect any skew of a transported media item, or any slip in the transport which may be detected as a long or wide media item.

The diverter may be operated by a solenoid powered via the electrical connector.

The chassis may include one or more physical presenter couplings (such as screw-threaded apertures) for connecting the media transport module to a presenter module.

The chassis may include one or more physical pick couplings (such as clasps) for connecting the media transport module to a pick unit.

The chassis may define an arch arranged to accommodate a portion (such as a presenter motor) of a media presenter thereunder when the media transport module is mounted in the media presenter.

The media transport module may comprise a banknote transport module.

By virtue of this aspect of the invention a removable media transport module is provided that does not include any motors therein, and that receives electrical and mechanical power from a media presenter and/or a pick unit to which the media transport is connected. This enables a media transport module to be provided as a field replaceable unit (FRU) for rapid replacement in the event of a failure of the module.

According to a second aspect there is provided a media presenter comprising a media transport module according to the first aspect.

The media presenter may further comprise a purge container. The purge container may comprise a first compartment including a slot aligned with the diverter port to receive media items ejected therethrough.

The media presenter may include a presenter motor for powering the presenter and located beneath the arch defined by the media transport module.

The media items may comprise banknotes, tickets, coupons, or the like.

According to a third aspect there is provided a media dispenser comprising one or more pick units coupled to the media presenter according to the second aspect.

According to a fourth aspect there is provided a self-service terminal incorporating the media dispenser of the third aspect. The self-service terminal may be an automated teller machine, an information kiosk, a financial services centre, a bill payment kiosk, a lottery kiosk, a postal services machine, a check-in and/or check-out terminal such as those used in the retail, hotel, car rental, gaming, healthcare, and airline industries, or the like.

The word "media" is used herein in a generic sense to denote one or more items, documents, or such like, in sheet form; in particular, the word "media" when used herein does not necessarily relate exclusively to multiple items or documents. Thus, the word "media" may be used to refer to a single item (rather than using the word "medium"), multiple items, and/or an indeterminate (or currently undetermined) number of items (either one or more). For example, a transport may receive media which is transported as a single item, but when tested by a media thickness sensor may actually comprise two media items superimposed and transported as if they were a single item.

According to a fifth aspect there is provided a method of transporting media items, the method comprising:

receiving a media item for transporting;

receiving a signal indicative of whether the received media item comprises an acceptable media item or an unacceptable media item;

energizing a diverter in the event that the received media item comprises an unacceptable media item and routing the media item to a diverter port;

transporting the received media item to a stacking port in the event that the received media item comprises an acceptable media item;

flicking the media item out of the stacking port using a first set of media flickers; and flicking the media item downwards once the media item has exited the stacking port to assist in stacking the media item.

According to a sixth aspect there is provided a controller programmed to implement the steps of the fifth aspect.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

BRIEF DESCRIPTION OF THE DRAWINGS

FIG. 4 is a right-sided sectional view of the media transport module of FIG. 1;

FIG. 5 is a further simplified right-sided view (a chassis sidewall has been removed) of the media transport module of FIG. 1;

FIG. 10 is a perspective view of part of the media transport module of FIG. 1; and FIG. 11 is a schematic side view of a media presenter including the media transport module of FIG. 1.

Figure 1:
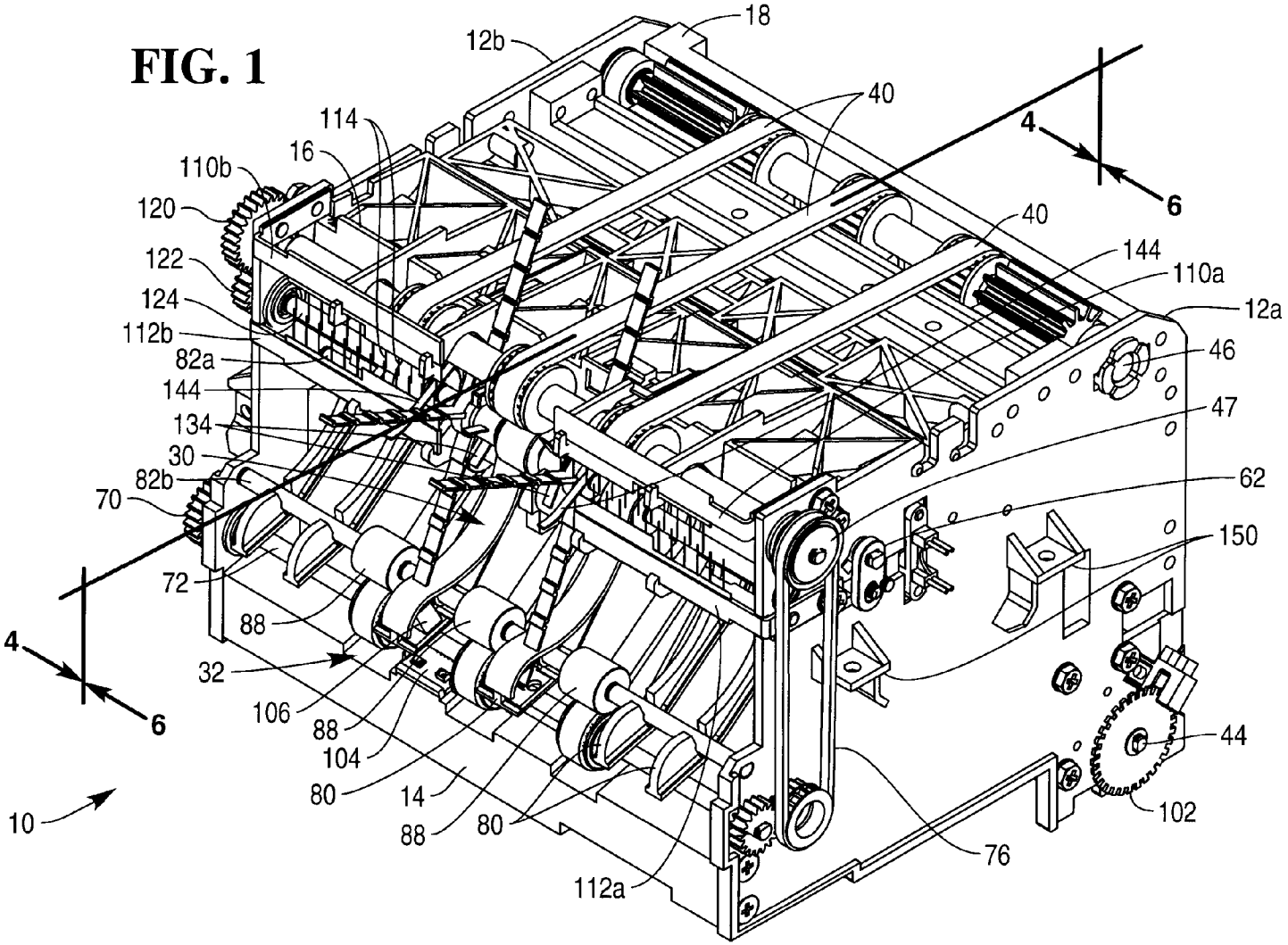
FIG. 1 is a front perspective view of a media transport module according to one embodiment of the present invention.

It should be appreciated that some of the drawings provided are based on computer renderings from which actual physical embodiments can be produced. As such, some of these drawings contain intricate details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features are removed from some views to further aid clarity.

DETAILED DESCRIPTION

Figure 2:
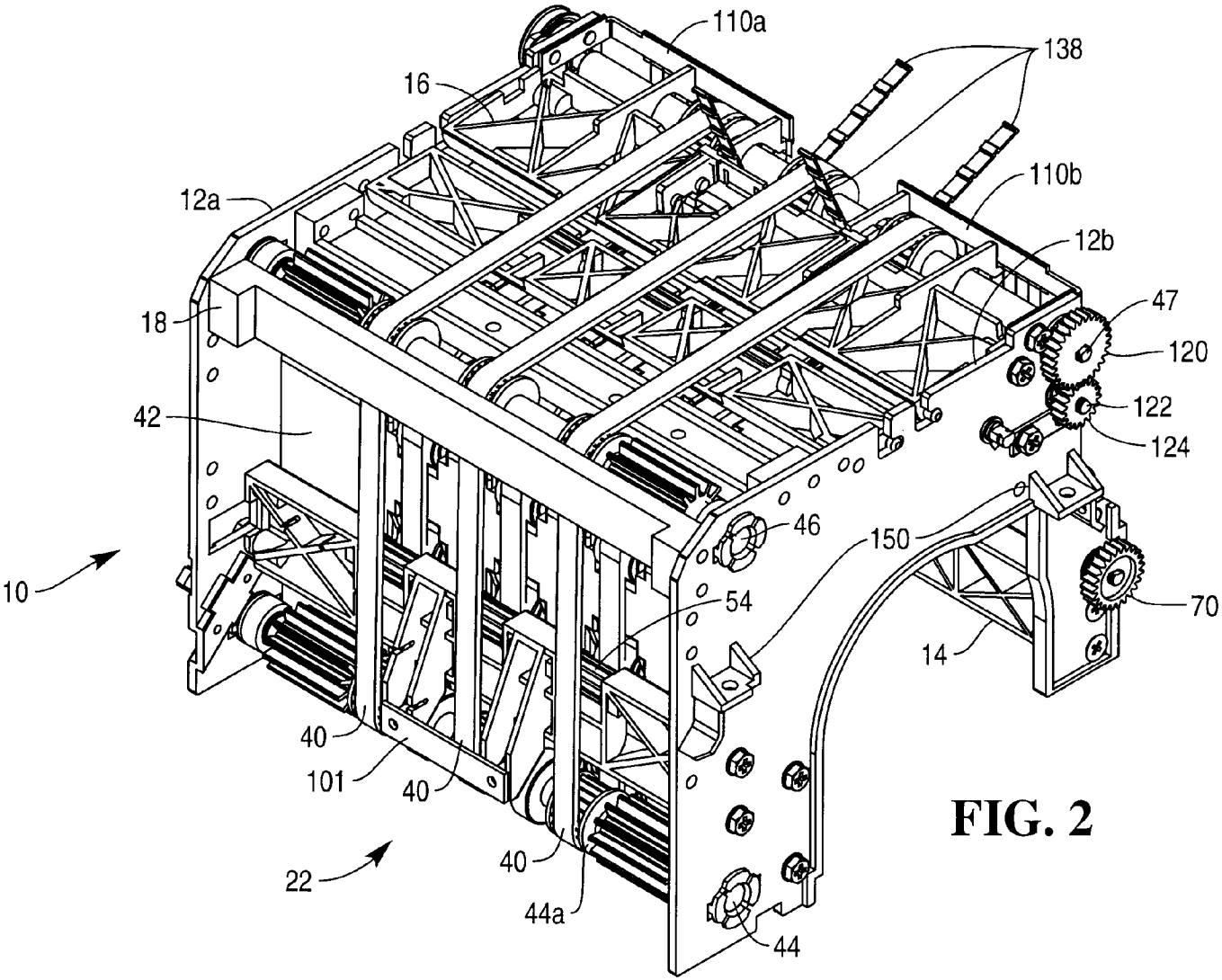
FIG. 2 is a rear perspective view of the media transport module of FIG. 1.
Figure 3:
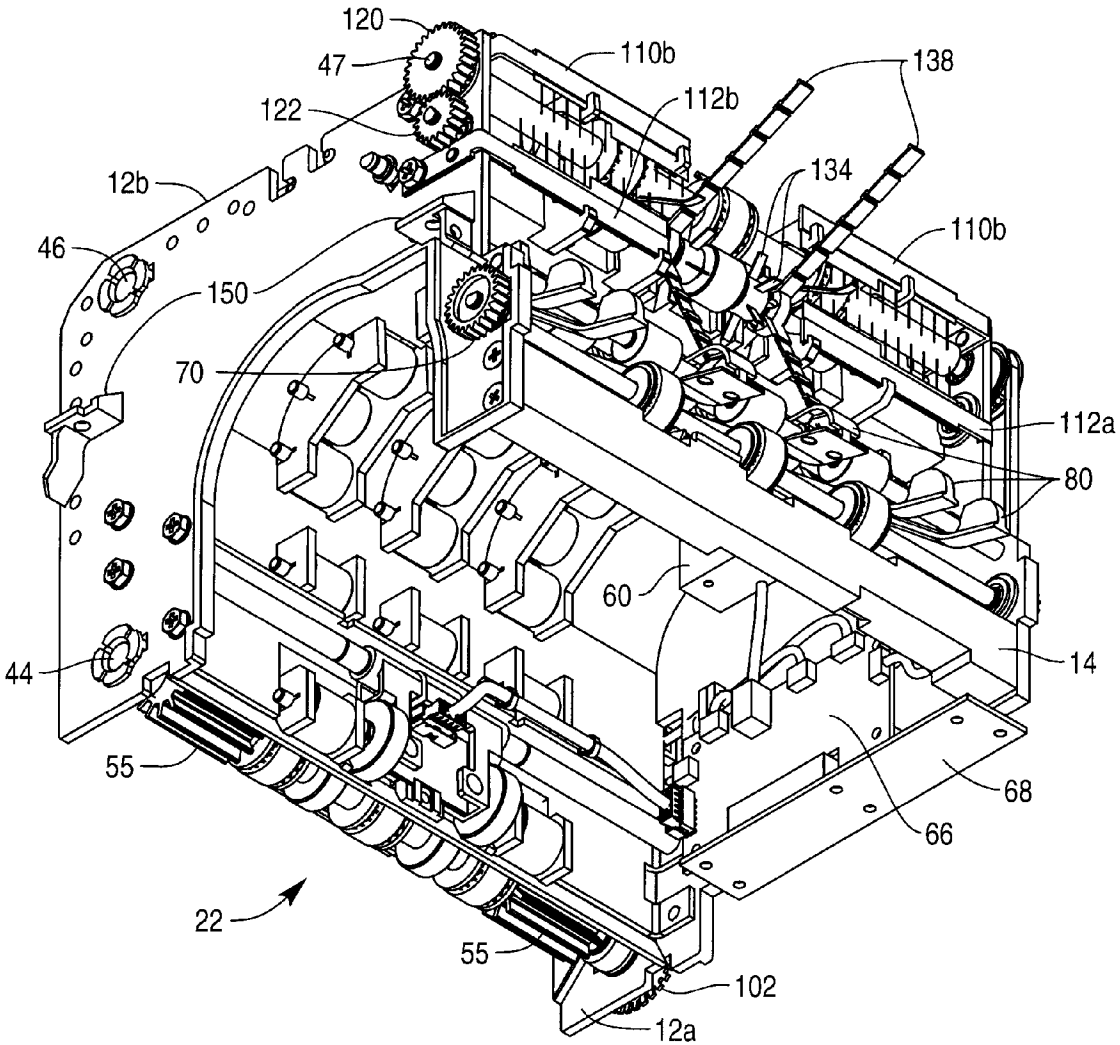
FIG. 3 is an underside perspective view of the media transport module of FIG. 1.
Figure 6:
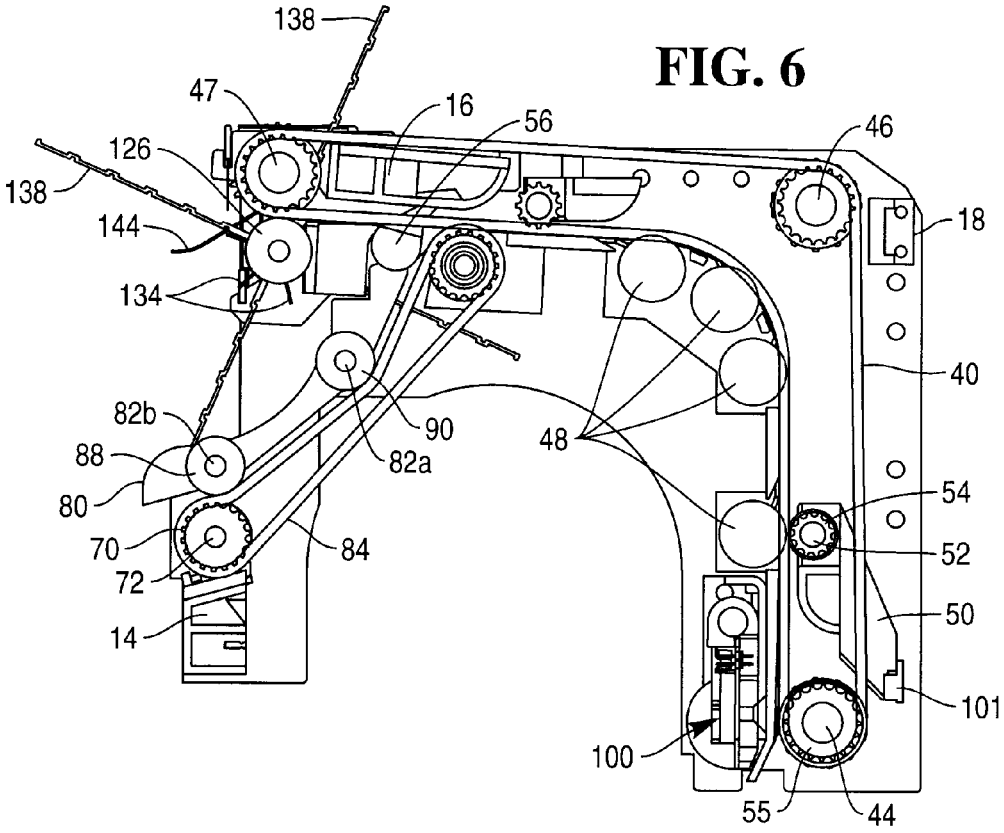
FIG. 6 is a left-sided sectional view of the media transport module of FIG. 1.
Figure 7:
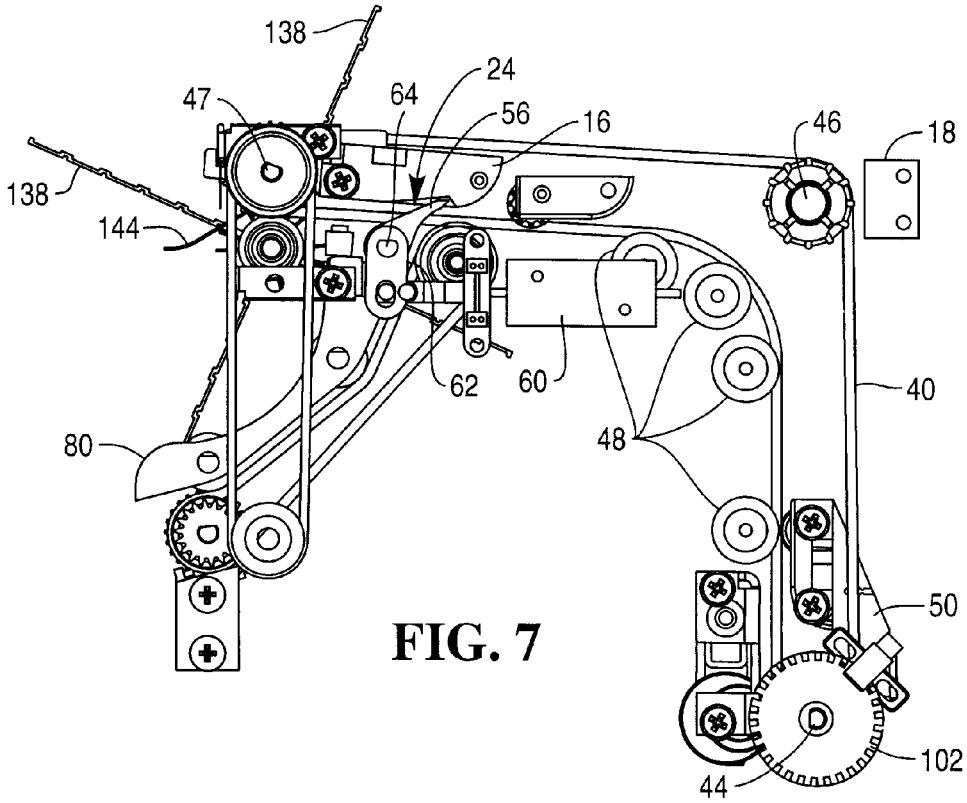
FIG. 7 is a further simplified left-sided view (a chassis sidewall has been removed) of the media transport module of FIG. 1.
Figure 8:
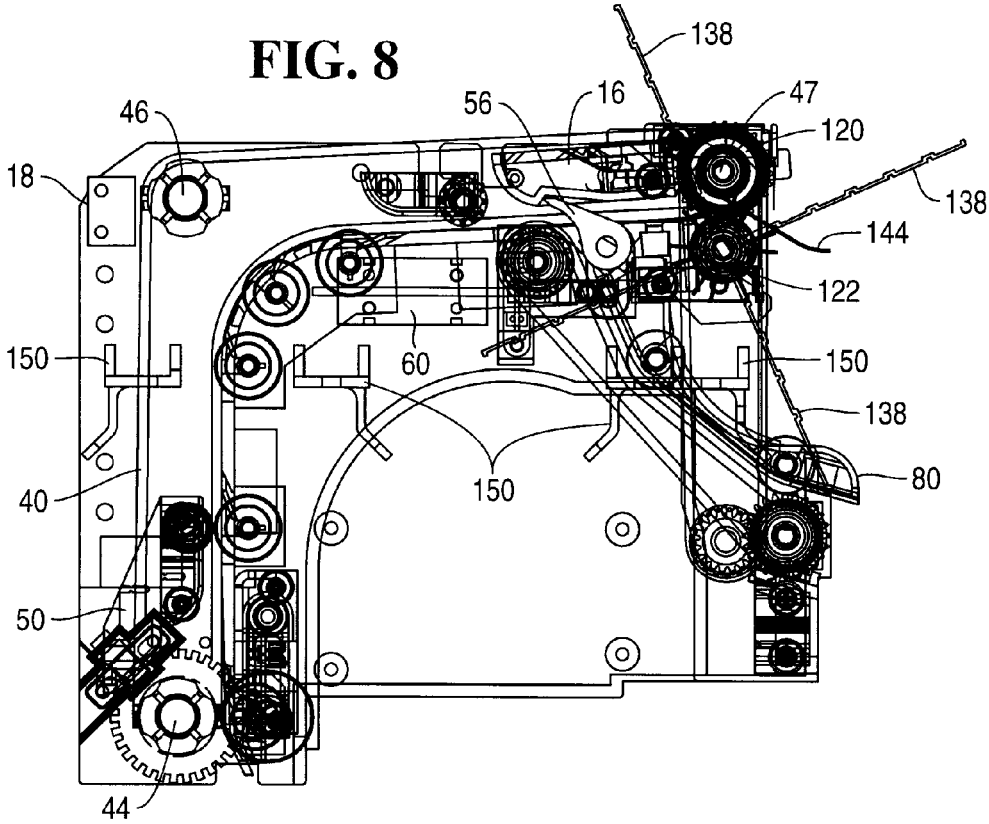
FIG. 8 is a right-sided view of the media transport module of FIG. 1.
Figure 9:
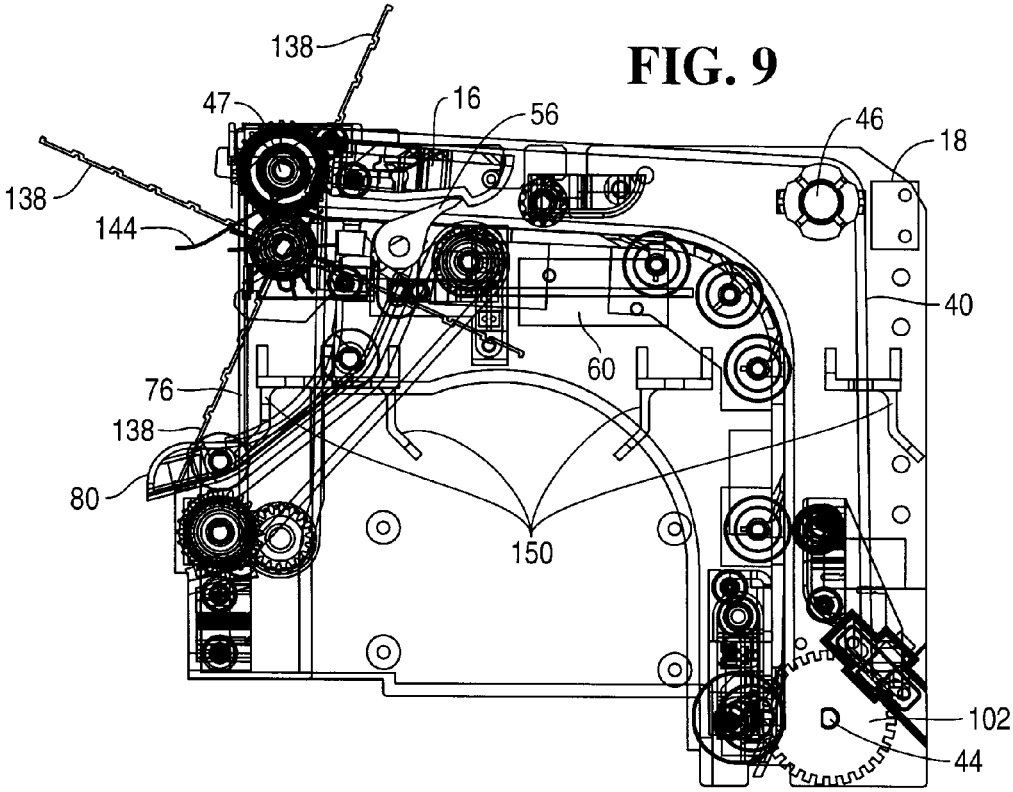
FIG. 9 is a left-sided view of the media transport module of FIG. 1.

Reference is first made to FIGS. 1 to 9, which are various views of a media transport module 10 according to one embodiment of the present invention. The media transport module 10 is in the form of a banknote transport module.

The banknote transport module 10 comprises a chassis 12 having two sidewalls 12*a*,12*b* between which various shafts, skid plates, and supports are mounted. A lower front support 14 and an upper front support 16 extend between the opposing sidewalls 12*a,b* and are used for improving rigidity of the module 10 and supporting sensors, as will be described in more detail below. A rear support bracket 18 also extends between the opposing sidewalls 12*a,b*.

The banknote transport module 10 further comprises: an upward transport 20 (FIGS. 4, 5) extending from a pick coupling area 22 to a diversion area 24, a divert transport 30 extending from the diversion area 24 (FIGS. 4, 5, and 7) to a diverter port 32, and a stacking transport 34 (FIGS. 4, 5) extending from the diversion area 24 to a stacking port 36 (FIGS. 4, 5).

In this embodiment, the stacking transport 34 and the upward transport 20 share some common parts, namely, three stretchable endless belts (the main transport belts) 40, a moulded skid plate 42, a lower rear shaft 44, an upper rear shaft 46, and an upper front shaft 47. The moulded skid plate is generally L-shaped (vertical, then arcuate, then horizontal).

Each of the main transport belts 40 is looped around a toothed pulley 44*a*,46*a*,47*a* on each of the three shafts 44,46, 47 respectively. The toothed pulleys 44*a*,46*a*,47*a* are fixed to the shafts 44,46,47 so that rotation of the upper front shaft 47 causes the lower rear shaft 44 and the upper rear shaft 46 to rotate.

The upward transport 20 includes rollers 48 mounted on the skid plate 42 and over which the main transport belts 40 are guided. The upward transport 20 also includes a support plate 50 extending between the opposing sidewalls 12*a*,12*b* and including a shaft 52 on which three paddle wheels 54 are mounted. The three paddle wheels 54 extend across and cooperate with a lower set of the rollers 48 to maintain the main transport belts 40 in close proximity to the moulded skid plate 42. The blades of the paddle wheels 54 are used to prevent a transported banknote from rising up between adjacent main transport belts 40 as the banknote is being transported. A pair of bladed rollers 55 are also mounted on the lower rear shaft 44 to prevent a banknote rising up when transported and to unfold any upward corner folds at the front of a transported banknote.

A diverter 56 is located at the diversion area 24 and is operable to route media items to either (i) the divert transport 30, or (ii) the stacking transport 34, as will be described in more detail below.

The diverter 56 is actuated by a solenoid 60, which moves a diverter arm 62 mounted on a diverter shaft 64. The solenoid 60 moves the diverter arm 62 from an unactuated (default) position to an actuated (deflecting) position, and then back to the unactuated position. Movement of the diverter arm 62 causes the diverter shaft 64 to rotate, thereby pivoting the diverter 56 between default and deflecting positions. At the default position, the diverter 56 causes media items to be transported to the stacking port 36; whereas, in the deflecting position (shown in FIGS. 4 to 9), the diverter 56 causes media items to be transported to the diverter port 32.

The solenoid 60 is powered by a control board 66 (shown in FIG. 3 only), which includes an insertion connector 68 for mating with a corresponding connector in a media presenter (not shown in FIGS. 1 to 9). This enables the banknote transport module 10 to receive electrical power from an external source (that is, the media presenter).

In addition to powering the solenoid 60, the control board 66 also powers various sensors (described in more detail below) within the banknote transport module 10.

The banknote transport module 10 also receives mechanical power from the media presenter. This is achieved using a main drive gear 70 that meshes with a corresponding gear (not shown in FIGS. 1 to 9) in the media presenter.

The main drive gear 70 is mounted on a lower end shaft 72, which is coupled to the upper front shaft 47 by a stretchable endless belt (the power transfer belt) 76. This enables mechanical power to be transferred to the upward transport 20 and the stacking transport 34.

The lower end shaft 72 forms part of the divert transport 30. The divert transport 30 further comprises: (i) a plurality of arcuate skid guides 80 mounted on a pair of fixed spindles 82 (upper spindle 82*a* and lower spindle 82*b*) in an axially spaced manner; (ii) three stretchable endless belts (diverter belts) 84 enclosing the lower end shaft 72 and an upper diverter shaft 86; (iii) three lower rollers 88 rotatably mounted on the lower fixed spindle 82*b*; and (iv) three upper rollers 90 rotatably mounted on the upper fixed spindle 82*a*. The upper 90 and lower 88 rollers are arranged to deflect the diverter belts 84, so that each diverter belt 84 is in contact with an upper roller 90 and a lower roller 88 except when a banknote is transported therebetween.

When a media item (such as a banknote) is routed to the divert transport 30, then the diverter belts 84 urge portions of the banknote into contact with the arcuate skid guides 80 until the banknote reaches the diverter port 32.

The banknote transport module 10 includes a media thickness sensor 100 (in the form of a banknote (or note) thickness sensor (NTS)). The banknote transport module 10 also includes a banknote (or note) width sensor (NWS) 101. The NTS 100 and the NWS 101 ascertain the thickness and area of a banknote being transported to determine (i) if multiple banknotes are being transported as a single banknote, (ii) if the banknote is skewed, (iii) if there are folds on the banknote, or (iv) if the banknote is perforated beyond an acceptable level. Banknote thickness sensors are well known to those of skill in the art, so will not be described in detail herein.

The NTS 100 and the NWS 101 provide an output signal to the control board 66 to indicate whether the banknote being tested by the NTS 100 is acceptable or not.

If the banknote being transported is acceptable, then the control board 66 leaves the solenoid 60 unactuated so that the banknote is transported to the stacking transport 34. If, however, the banknote being transported is unacceptable, then the control board 66 actuates the solenoid 60 so that the diverter 56 is pivoted to the deflected position (as shown in FIGS. 4 to 9) and the banknote is transported to the divert transport 30.

The banknote transport module 10 includes a timing disc 102 mounted on one end of the lower rear shaft 46 and outside sidewall 12*a*. This timing disc 102 is used to synchronize the operation of the components within the banknote transport module 10, such as the diverter 56 and the transports 20,30, 34.

A banknote sensor 104 is provided on the lower front support 14 mounted between two of the diverter belts 84. The banknote sensor 104 transmits light to a prism 106 mounted on one of the arcuate skid guides 80, which reflects the transmitted light back to the sensor 104. Any banknote present at the diverter port 32 will block the transmitted light and be detected by the banknote sensor 104.

A pair of upper facings 110*a,b* and a pair of lower facings 112*a,b* are Mounted between the opposing sidewalls 12*a*, 12*b*, and partially define the stacking port 36. The upper facings 110 include anti-static brushes 114 depending therefrom; and the lower facings 112 include anti-static brushes 114 upstanding therefrom. The anti-static brushes 114 contact banknotes as they exit from the stacking port 36 and discharge any static electricity on the banknotes.

The stacking transport 34 further comprises a port gear 120 mounted on one end of the upper front shaft 47, outside the sidewall 12*b*. The port gear 120 meshes with a flicker gear 122, mounted on a flicker shaft 124 located beneath the upper front shaft 47. As the port gear 120 is rotated, the flicker gear 122 rotates causing the flicker shaft 124 to rotate.

Reference will now also be made to FIG. 10, which shows the flicker shaft 124 in more detail.

Three pinch rollers 126 are mounted on the flicker shaft 124 in registration with the toothed pulleys 47*a* mounted on the upper front shaft 47.

A first set of media flickers 130 and a second set of media flickers 132 are also mounted on the flicker shaft 124 and rotate as the flicker shaft 124 rotates.

The first set of media flickers 130 comprise relatively short stubs 134 of plastic of approximately 7 mm length, extending radially from a hub 136 mounted on the flicker shaft 124. These short stubs 134 engage with a lower surface of a transported banknote and flick the banknote forwards as the banknote exits the stacking port 36.

The second set of media flickers 132 comprise relatively longs flaps 138 of plastic of approximately 35 mm length, extending radially from a hub 140 mounted on the flicker shaft 124. These long flaps 138 are retained by a lower surface of a transported banknote prior to the banknote exiting from the stacking port 36, and are then retained by the upper front shaft 47 as the hubs 140 continue to rotate. Further rotation of the hubs 140 causes the long flaps 138 to clear the upper front shaft 47 and then exert downwards pressure on an upper surface of the banknote that has just exited the stacking port 36. The long flaps 138 thereby assist with stacking the banknote on an external surface.

A pair of deflectors 144 are also mounted near the flicker shaft 124. These deflectors 144 encourage the leading edge of a banknote downwards as it exits the stacking port 36 to provide as much room as possible for the following banknote to land on the external surface.

The chassis 12 includes physical couplings 150 in the form of brackets to allow the chassis to be coupled to a presenter module, as will now be described with reference to FIG. 11, which illustrates a banknote presenter module 200 including the banknote transport module 10 mounted therein.

The banknote presenter module 200 comprises: a presenter chassis 212, the banknote transport module 10 for coupling to a pick unit (not shown) of a dispenser (not shown), a purged banknote container 218, a carriage 220, a cam block 222, a registration device 224, a carriage track 226, and a control board (shown by dotted line 228). The control board 228 is used to control the operation of the presenter module 200.

The carriage 220 can be moved to a loading position (as shown in FIG. 11) at which position the cam block 222 can be rotated to open the carriage 220 so that the carriage 220 can be filled with banknotes from the banknote transport module 10. When the carriage 220 is moved to the open position, the registration device 224 provides a registration edge against which a group of banknotes can be stacked, as banknotes are received from the banknote transport module 10. As each banknote is ejected from the stacking port 36 of the banknote transport module 10, the long flaps 138 flick onto the upper surface of that banknote (which is now the topmost banknote in the stack on the carriage) that has just exited. This flicking action causes the banknote to be urged downwards and against the registration edge, thereby helping to create a neat stack of banknotes on the carriage.

When the required banknotes have been stacked in the carriage 220, the cam block 222 can be rotated in the reverse direction to close the carriage 220. When closed, the carriage 220 can then be moved along the carriage track 226 to a protruding end (the presenting end) 230 of the presenter chassis 212 to present the stack of banknotes to a customer.

The purged banknote container 218 defines a pre-stack slot 232 and a post-stack slot 234. The pre-stack slot 232 is aligned with the divert port 32 for receiving diverted banknotes therefrom. The post-stack slot 234 is aligned with part of the carriage track 226 and receives banknotes that have been stacked in the carriage 220 but which the control board 228 decides should be stored.

When the diverter 56 is in the default (unactuated) position, the banknote transport module 10 defines a stacking path 240 (illustrated by an arrow line in FIG. 11) using the upward transport 20 and the stacking transport 34.

When the diverter 56 is in the deflecting (actuated) position, the banknote transport module 10 defines a divert path 242 (also illustrated by an arrow line in FIG. 11) using the upward transport 20 and the divert transport 30.

Banknotes are received from a pick unit (not shown), in the direction shown by arrow 250. Each received banknote passes through the NTS 100, which implements a banknote sensor test. The diverter 56 is activated to divert any banknote failing the banknote thickness sensor test through the diverter port 32 and into the pre-stack slot 232.

If the purged banknote container 218 is full, then the banknote transport module 10 will detect this because the banknote sensor 104 and prism 106 will detect that a banknote is still present at the diverter port 32. Any further banknotes that need to be diverted will be sent to the carriage 220, and then the entire contents of the carriage will be transported to the purged banknote container 218 via the post-stack slot 234.

Various modifications may be made to the above described embodiment within the scope of the present invention. For example, in other embodiments, the media transport module may be used for transporting checks, tickets, coupons, passes, licenses, or the like.

Different components may be used in the transport sections than those described above, for example, a gear train may be used.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A media transport module the media transport module being removably connected to the media presenter, comprising:

an upward transport extending from a pick coupling area to a diversion area and operable to route individual media items from the pick coupling area to the diversion area;

a divert transport extending from the diversion area to a diverter port;

a stacking transport extending from the diversion area to a stacking port;

a diverter located at the diversion area and operable, in response to a signal received from a media thickness sensor, to route media items to either (i) the divert transport, or (ii) the stacking transport;

a drive gear drivingly connectable to a motor associated with a media presenter separate from and external to the media transport module, and for (i) receiving rotational mechanical power from the motor associated with the media presenter, and (ii) imparting the received rotational mechanical power to the upward transport, the divert transport, and the stacking transport; and an electrical connector connectable to a corresponding electrical connector of an external source, and for (i) receiving electrical power from the external source, and (ii) using the received electrical power to energize the diverter.

2. A media transport module according to claim 1, wherein the stacking port comprises a first set of media flickers mounted on a shaft.

3. A media transport module according to claim 2, wherein the first set of media flickers are mounted beneath a media path defined by the stacking transport and are deflected by a media item passing above the first set of media flickers.

4. A media transport module according to claim 3, wherein the stacking port comprises a second set of media flickers at the stacking port mounted co-axially with the first set of media flickers.

5. A media transport module according to claim 4, wherein the second set of media flickers are longer than the first set of media flickers, and longer than the width of a media item being transported, so that the second set of media flickers act to push down the media item once the media item has exited the stacking transport.

6. A media transport module according to claim 1, wherein the media transport module further comprises a chassis defining skid plates forming part of the upward transport and the stacking transport.

7. A media transport module according to claim 1 wherein the stacking port delivers banknotes to a carriage which stacks banknotes received from the media transport module.

8. A media transport module according to claim 1, wherein the diverter includes a solenoid which is separate from the electrical connector and is powered via the electrical connector.

9. A media transport module according to claim 1, wherein the divert transport comprises a plurality of arcuate skid guides and a plurality of stretchable endless belts located between adjacent arcuate skid guides.

10. A media presenter comprising a media transport module according to claim 1.

11. A media presenter according to claim 10, wherein the media presenter further comprises a purge container including a first compartment defining a slot aligned with the diverter port to receive media items ejected therethrough.

12. A media transport module according to claim 1 wherein the drive gear is configured to mesh with a corresponding gear in the media presenter.

13. A media transport module according to claim 12 wherein the media transport module does not include any motors therein, and receives electrical and mechanical power from the media presenter.

14. A method of transporting media items, the method comprising:

receiving a media item for transporting;

receiving a signal indicative of whether the received media item comprises an acceptable media item or an unacceptable media item;

energizing a diverter in the event that the received media item comprises an unacceptable media item and routing the media item to a diverter port;

transporting the received media item to a stacking port in the event that the received media item comprises an acceptable media item;

flicking the media item out of the stacking port by directly using a first set of media flickers; and flicking the media item downwards once the media item has exited the stacking port to assist in stacking the media item utilizing a second set of media flickers.

15. A method according to claim 14, wherein the method further comprises: sensing whether a media item is present at the diverter port to ascertain if a purge container is full.

16. A controller programmed to implement the steps of claim 14.

* * * * *